United States Patent [19]

Clark

[11] 3,981,220

[45] Sept. 21, 1976

[54] SNARE DRUM WITH TONE RING

[75] Inventor: Forrest W. Clark, Fountain Valley, Calif.

[73] Assignee: CBS Inc., New York, N.Y.

[22] Filed: Oct. 6, 1975

[21] Appl. No.: 619,779

[52] U.S. Cl. ..... 84/415
[51] Int. Cl.[2] ..... G10D 13/02
[58] Field of Search ..... 84/411, 415–417

[56] References Cited

UNITED STATES PATENTS

| | | | |
|---|---|---|---|
| 578,198 | 3/1897 | Boulanger | 84/411 |
| 663,854 | 12/1900 | Boulanger | 84/411 |
| 1,767,133 | 6/1930 | Hunt | 84/411 |
| 3,113,481 | 12/1963 | Thompson | 84/415 |
| 3,215,021 | 11/1965 | Kester | 84/411 |
| 3,635,119 | 1/1972 | Thompson | 84/411 |

*Primary Examiner*—Lawrence R. Franklin
*Attorney, Agent, or Firm*—Gausewitz, Carr & Rothenberg

[57] ABSTRACT

A snare drum is formed of a batter head assembly and a snare head assembly fixedly held in mutually spaced apart relation by a number of support rods. A cylindrical tone ring is seated upon the snare head assembly and extends toward but short of the batter head assembly to provide a resonating chamber for the snare head.

15 Claims, 7 Drawing Figures

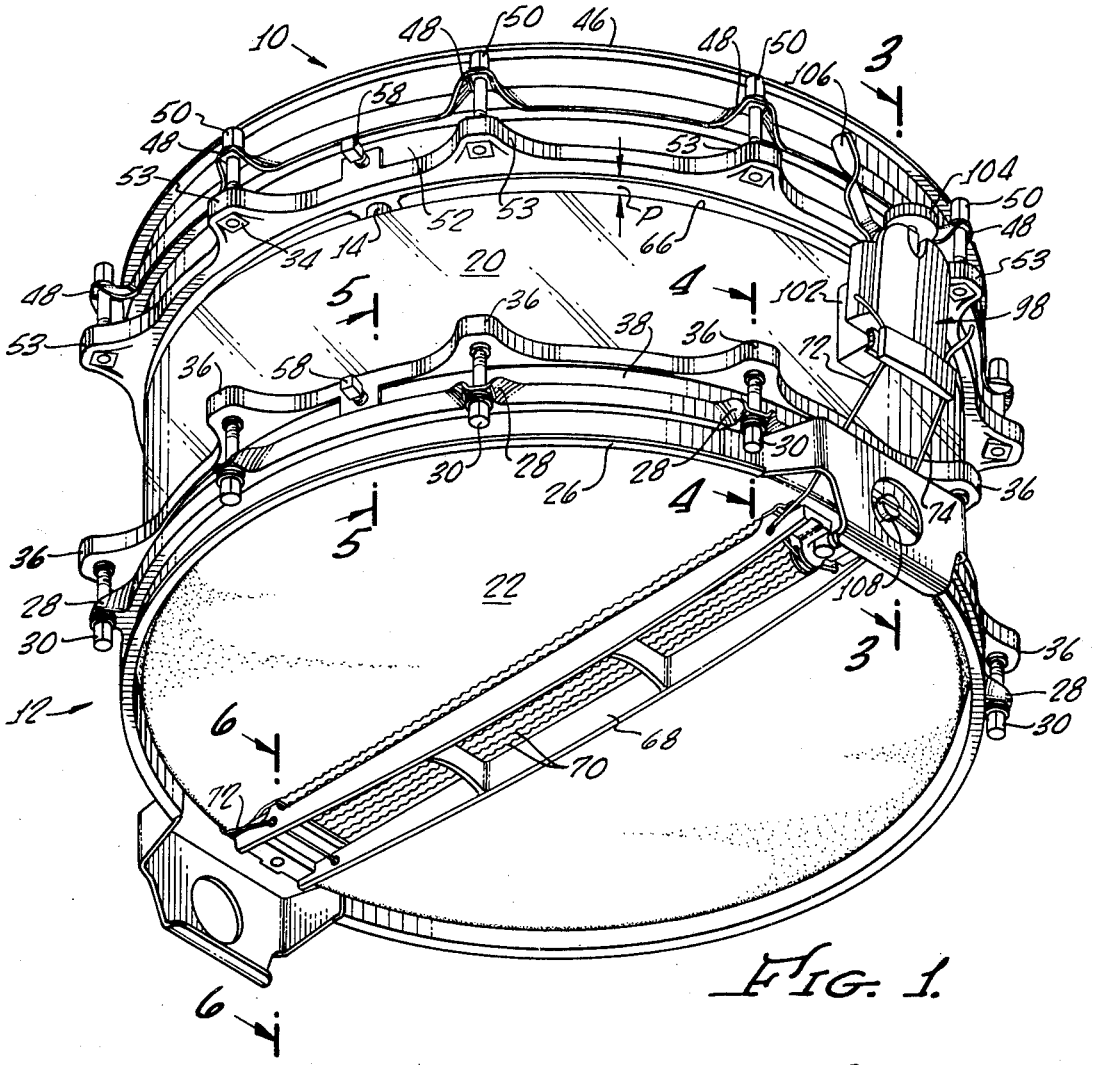
FIG. 1.
FIG. 2.
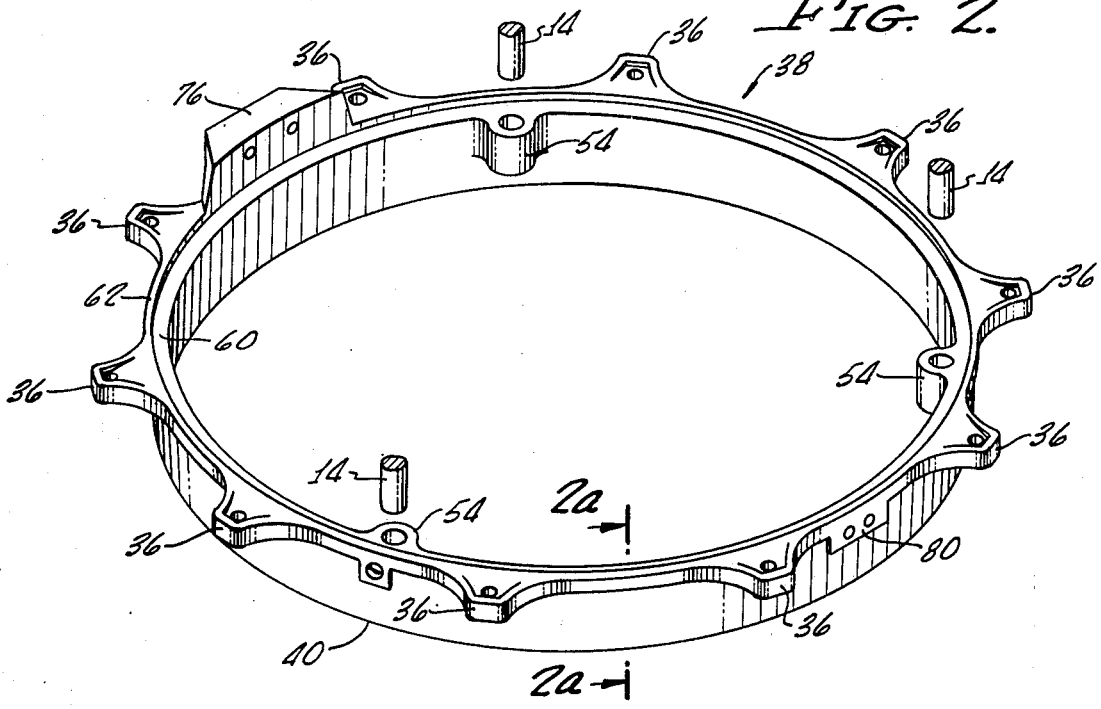

FIG. 2a.
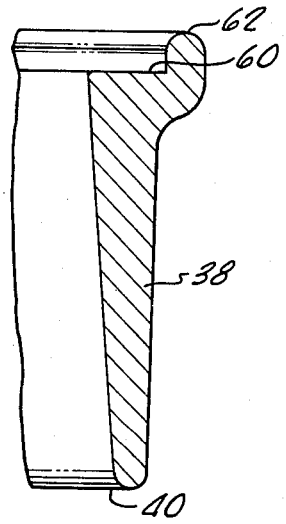
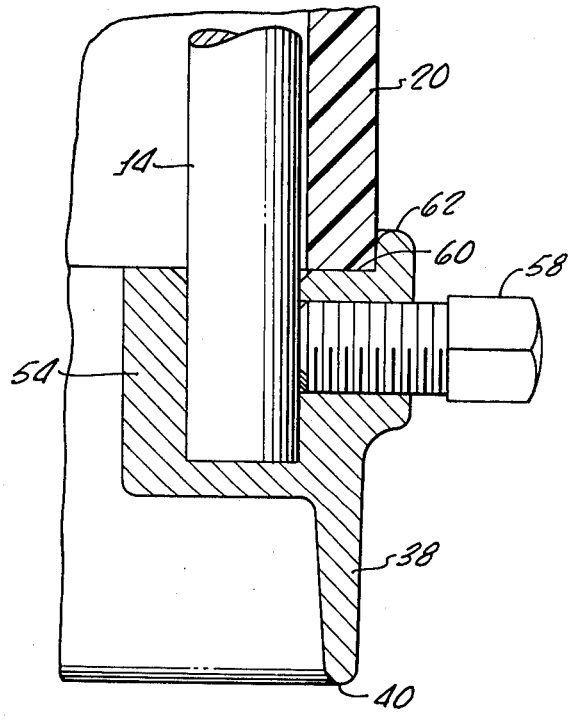
FIG. 5.
FIG. 4.
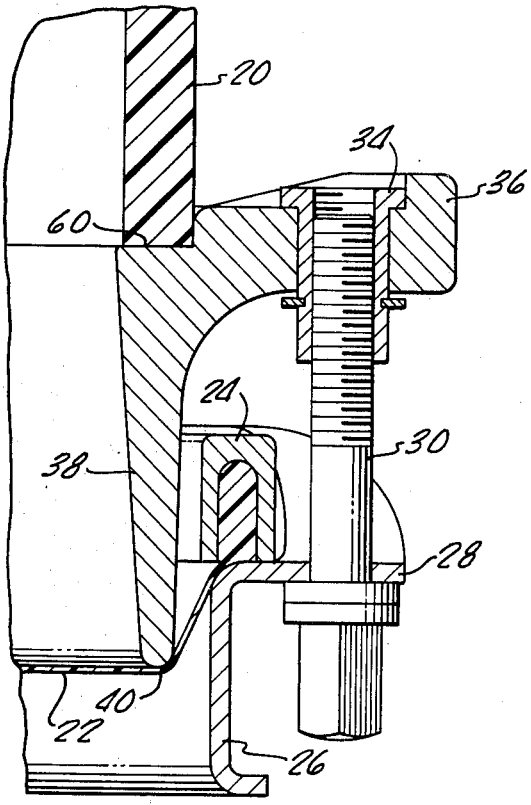
FIG. 6.
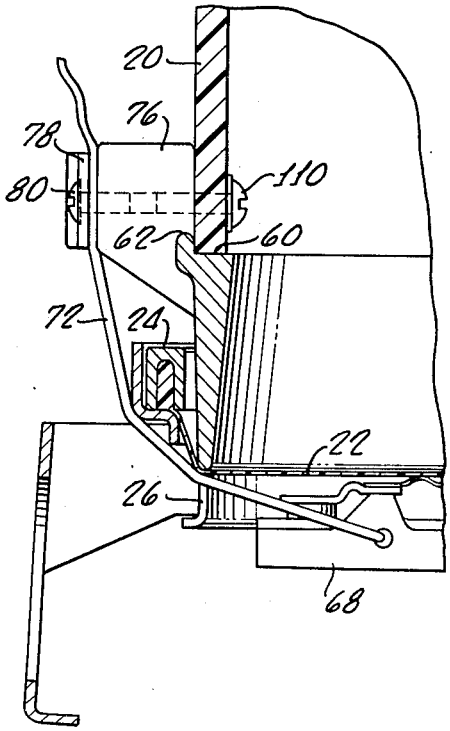

SNARE DRUM WITH TONE RING

BACKGROUND OF THE INVENTION

This invention relates to snare drums and more particularly concerns a snare drum having improved and amplified snare sound.

Many different types of constructions have been employed for snare drums for a variety of different purposes including ready adjustment and throw off of the snare wires, mounting and tensioning of the parts, commercial and economic manufacture and use, and ready portability and separability of the batter and snare head. Thus, U.S. Pat. No. 3,113,481 to J. B. Thompson describes certain snare drum mechanisms. U.S. Pat. No. 3,635,119 to J. B. Thompson describes an improved rigid lightweight snare drum structure and the patents to Boulanger, U.S. Pat. Nos. 663,854, 578,198 and 371,415 describe two-part drum structures where the two parts may be readily coupled and uncoupled for different utilization. Nevertheless, none of the prior art known to applicant concerns attempts to improve and amplify tone quality of the snare drum and particularly of the snare sound thereof. The patent to Hunt, U.S. Pat. No. 1,767,133, describes a double drum structure wherein a pair of drum units each including a batter head and a snare head are fixed to each other so that the drum, having sound qualities of a snare drum, can be beaten on either side. The arrangement provides an air chamber between the inner snare heads which is said to provide a pleasing tone quality. Yet, the complexity of this double drum structure makes it difficult and costly to manufacture and is a significant obstacle to commercial feasibility. Hunt has no tubular tone ring adjacent either batter head but merely a space between the two snare heads.

Accordingly, it is an object of the present invention to provide a snare drum of improved tonal quality that is economical, rugged and lightweight.

SUMMARY OF THE INVENTION

In carrying out principles of the present invention in accordance with a preferred embodiment thereof, there are provided mutually spaced batter and snare head assemblies. A tone ring is fixed to the snare assembly to extend toward the batter head assembly. The tone ring includes means for defining a resonating chamber contiguous to the snare head assembly and having a port extending circumferentially around the drum in close adjacency to the batter head assembly. From another point of view a snare head and batter head are held in mutually spaced fixed relation with no drum shell therebetween. A cylindrical tone ring is coupled with the snare head to provide a tubular resonating chamber that is substantially completely open at an end thereof remote from the snare head.

BRIEF DESCRIPTION OF THE DRAWINGS

FIG. 1 is a perspective view of a snare drum embodying principles of the present invention;

FIG. 2 is a perspective view of a snare ring of the drum of FIG. 1;

FIG. 2*a* is a fragmentary sectional view of a typical ring;

FIG. 4 is a fragmentary sectional view showing a portion of a mounting of a head;

FIG. 5 is a fragmentary sectional view showing mounting of a support rod; and FIG. 6 is a fragmentary sectional view showing the mounting of one side of the tone ring.

DETAILED DESCRIPTION

Figure 3:
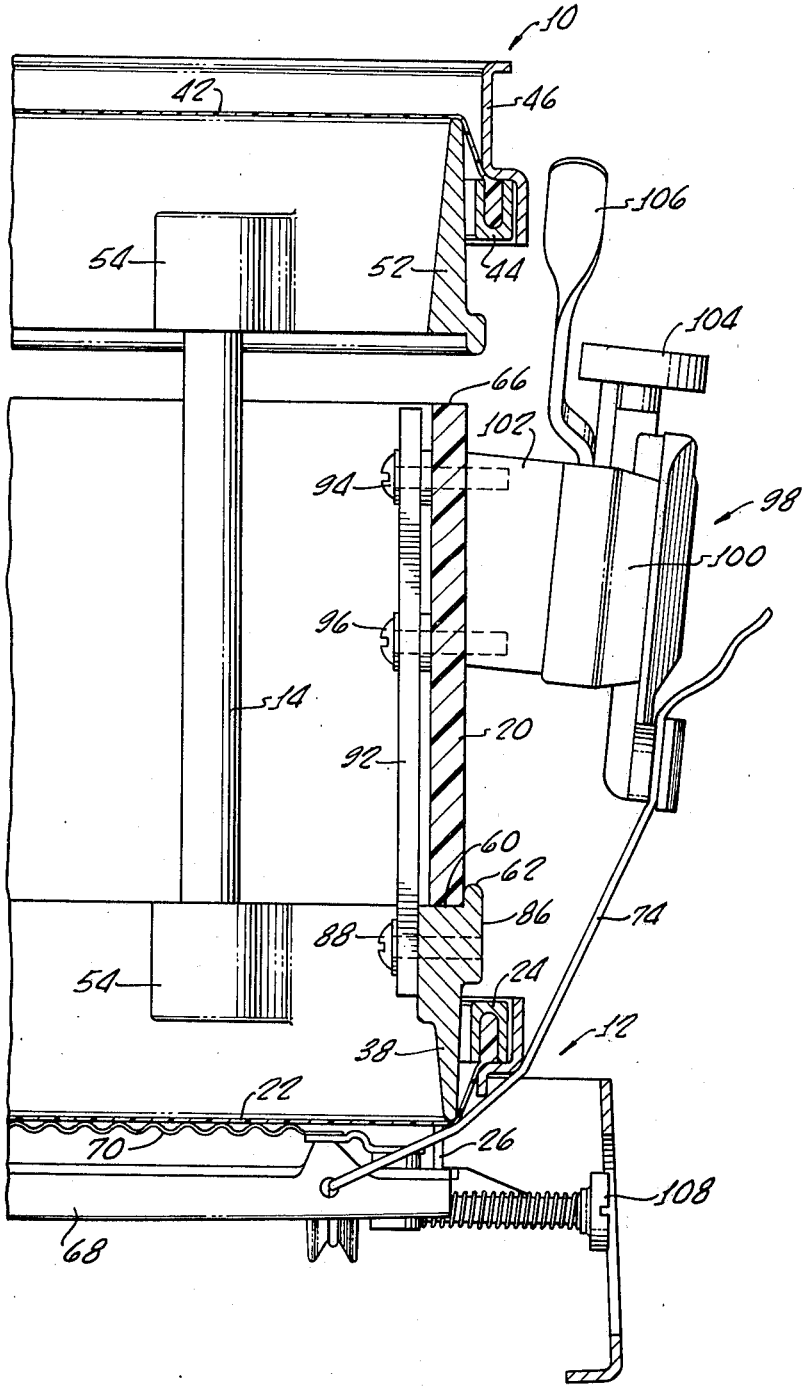
FIG. 3 is a fragmentary sectional view illustrating details of the head assemblies, tone ring and throw off mounting.

As illustrated in FIG. 1 a snare drum embodying principles of the present invention generally includes a batter head assembly 10, a snare head assembly 12 and a number of support rods fixedly connected to assemblies 10 and 12 to hold these in mutually spaced relation to each other. The support rods are three in number in the illustrated embodiment, but only one, rod 14, is shown in FIGS. 3 and 5. The last major component of this snare drum comprises a tubular or circular cylindrical tone ring 20 which is mounted in close contiguous relation to the snare head assembly and extends to but is spaced from the batter head assembly. Being spaced from the batter head assembly, the tone ring 20 cooperates with the latter to define a circumferentially extending port P for the tubular resonating chamber. The port is defined between the batter head and tone ring.

The batter head assembly and snare head assembly are substantially similar to each other except for the mounting of the snare frame and wires and snare throw off mechanism. Both of the heads, the snare head and the batter head, are carried and mounted in the manner described in U.S. Pat. No. 3,635,119 for Snare Drum Having Tapered and Flanged Cast Metal Shell and Cast Strainer Mounting Means, invented by J. B. Thompson and assigned to the assignee of the present invention. Briefly, with respect to the mounting of the snare head as illustrated in FIG. 4, a snare head 22 is suitably secured in a flesh hoop 24 which is held in place by a counter hoop 26 having a plurality of circumferentially spaced radially outwardly extending hoop flanges 28 which form seats for tensioning screws 30 that extend through apertures in the hoop flanges and are threadedly engaged with nuts 34 captured within the opposite sides of ring flanges 36. Ring flanges 36 (see also FIG. 2) are radially outwardly projecting and equally circumferentially spaced connecting elements integrally formed on a snare ring 38 which is analagous to the shell of U.S. Pat. No. 3,635,119, but which is a considerably shortened and otherwise modified version thereof. Ring 38 (See FIGS. 2–6) has a fairly large base wall thickness which dimishes progressively from its base portion to outermost portions which provide an annular bearing edge 40 upon which is seated and tensioned the snare head 22, the tensioning being provided by drawing the counter hoop 26 together with flesh hoop 24 more closely toward the ring flanges 36 by tightening of the tensioning screws 30. There is one tensioning screw 30 and counter hoop seat for each ring flange 36.

The batter head assembly is substantially identical to thet snare head assembly with the exception of certain snare mounting elements to be described hereinafter. Thus, as shown in FIGS. 1 and 3, the batter head assembly includes a batter head 42 and flesh hoop 44 held in place by a counter hoop 46 having a plurality of batter hoop flanges 48 that receive and respectively seat a number of batter head tensioning screws 50. Elements 42 through 50 may be identical to corresponding elements of the snare head assembly except for different choice of materials for the heads as may be deemed necessary or desirable.

A batter ring 52 is identical to snare ring 38 except for certain reinforced portions or bosses to be described below. Ring 52 includes a plurality of ring flanges 53 respectively mounting captured nuts 34 which threadedly receive tensioning screws 50 to secure and tension the batter head 42.

As illustrated in FIGS. 2 and 5, each of the rings includes a number (three are employed in the preferred embodiment) of inwardly extending bosses 54, which are equally spaced around the periphery of the ring. Each boss has an axially facing recess receiving one end of one of the three support rods 14. The latter are retained in position within the respective boss recesses by a plurality of support rod retaining screws 58 that are threaded through the wall of the batter and snare rings and are threadedly forced against ends of the support rods that are received in the boss recesses. Spacing between the batter and snare head assemblies is readily adjusted by employing different lengths of support rods 14.

Preferably, the snare and batter rings are respectively integrally cast of a suitable strong and lightweight metal, such as aluminum. The flesh and counter hoops are integrally formed of a similar metal.

As shown in FIG. 2*a*, snare ring 38 has its base formed with an axially facing annular shoulder 60 which is circumscribed by an axially projecting circumferential flange 62. Seated upon, or at least in close contiguity with the shoulder 60 and contained and confined within the circumscribing flange 62, is a circular cylindrical or tubular tone ring 20 (FIGS. 3–6) that extends between the flange 62 and the support rods 14 toward but short of the innermost or bottom edge of batter ring 52.

As best shown in FIG. 3, the tone ring preferably is secured to the remaining structure of the drum solely at the edge thereof which is contiguous to the snare head assembly and, further, is completely free of attachment to the remaining drum structure at the end remote from the snare head assembly. Thus, the tone ring 20 defines a resonating chamber with the snare head tensioned across the bottom of this tubular resonating chamber. The chamber is an open-ended tube. Stated otherwise, the chamber is ported, a continuous circumferentially extending port P being defined by the edge 66 of the tone ring 20 which is adjacent to but spaced from the batter ring 52. Although a 360° continuous circumferential port is illustrated and preferred, the port may also take the form of a circumferentially discontinuous gap in the form of a plurality of slots or gaps between the tone ring and batter head assembly.

Tone ring 20 is conveniently secured to and within the flange 62 of the snare ring 38 by structure provided to mount the snare wires themselves.

A conventional snare frame 68 carries a number of snare wires 70 and is supported by pairs of snare suspension cords 72, 74. Snare ring 38 includes a laterally outwardly projecting and enlarged snare lug 76 (FIG. 6) having a pair of spaced apertures extending therethrough. A snare cord plate 78 is tightly held against the outer surface of lug 76 by means of screws 80. Snare suspension cords fixed to one end of the snare frame extend over the snare counter hoop 26 (which has an upstanding flange thereof cut away to allow passage of the suspension cords) and are captured and tightly held to and between the plate 78 and lug 76.

As illustrated in FIG. 3, at a point diametrically opposed to the enlarged snare lug 76, is another enlarged portion 86 of the snare ring 38. Fixed to the snare ring at this enlarged portion by means of screws 88, is a throw off support plate 92 which projects axially from the snare ring 38 toward but short of the batter ring 52. Fixed to support plate 92 by means of screws 94, 96 is a snare throw off mechanism 98 which may be substantially the same as that described in U.S. Pat. No. 3,635,119. Throw off mechanism 98 securely captures snare suspension cord 72, 74 which are connected at the other ends thereof to the snare frame 68 and extend over the snare counter hoop 26, which has its upstanding axially extending flange cut away to allow passage of these suspension cords. Throw off support mechanism 98 includes a body section 100 containing a mechanism such as that illustrated in detail in U.S. Pat No. 3,635,119 and a base or standoff portion 102 projecting radially inwardly for abutment with the tone ring 20. Base 102 has a length sufficient to space the throw off mechanism at the proper radially outwardly distance for ease of operation and securement to the snare suspension cords. The throw-off mechanism includes an adjustment screw 104 to adjust the tension of the suspension cords and an operating lever 106 which is movable to a first position which releases the snare and snare frame for a straight drum sound and to a second position wherein the snare wires are drawn against the snare head to obtain the snare sound. Snare wire tension is adjusted by a tension control screw 108 threaded in the snare bed 68 and connected to the snare wires.

As previously mentioned, the described arrangement for mounting the snare frame, snare wires and throw off mechanism is conveniently employed to fix the tone ring to and in close contiguity with the ring of the snare head assembly. Thus, as illustrated in FIG. 3, tone ring 20 extends from the shoulder 60 of snare ring 38 along support plate 92 and between this plate and the throw off mechanism. The tone ring is apertured to receive the screws 94, 96 which mount the throw off mechanism to the support plate. Accordingly, the tone ring is interposed between the throw off mechanism and its support plate and all of these are fixedly secured to each other by the same retaining elements, screws 94, 96.

In a somewhat analagous manner, on the diametrically opposed side of the snare ring 38, tone ring 20 is also secured to the enlarged ring portion employed to mount and fix the snare suspension cords on this side of the drum (FIG. 6).

The enlarged apertured snare supporting lug 76 is employed to secure tone ring 20 at a point opposite the throw off mechanism. A pair of screws 110 extend through apertures in the lower end of the tone ring adjacent the edge thereof which abuts snare ring shoulder 60 and are threaded into the apertures in the lug 76. Preferably, the apertures receiving screws 110 are the same as those receiving screws 80 which screws are respectively screwed into opposite ends of the same apertures of the lugs 76. In the disclosed embodiment, the tone ring is formed of a rectangular acrylic sheet 25/100ths of an inch thick. The sheet is bent to the circular cylindrical shape illustrated and the edges thereof adhesively secured to each other substantially at a midpoint of the lug 76. Screws 110 are placed on both sides of the joint between the abutting edges of the bent tone ring sheet and thus also aid in retaining the circular configuration thereof.

The invention described herein has been initially embodied in a snare drum having a 14-inch diameter and a 6½ inch depth, measured between the batter and snare heads. With this drum, the port P preferably has a length, measured axially of the drum between the free edge 66 of the tone ring and the most closely adjacent edge of the batter ring, of ½ to ⅝ inches. This arrangement is found to provide a greatly improved tonal quality and amplification of the snare sound of this drum. The snare sound is the sound made when the snare wires are held in contact with the snare head. This arrangement provides a great amplification of the snare sound without substantial increase in intensity of the drum sound. It is believed that this is due to the fact that the described tone ring provides a tubular resonating chamber operable primarily upon the snare head, providing a resonating chamber for the snare head. Concomitantly, the position of the tone ring and the location of the port P immediately adjacent the batter head assembly affords a minimum resonating effect of the tone ring upon the batter head itself. Thus, the desired resonating and amplification of the snare head is achieved without significant amplification or resonating of the batter head.

It has been found in practice that the described tone ring provides an unexpected and surprising improvement in the snare sound. Not only is there significant amplification of the snare sound but the sound is louder, brighter, sharper and more penetrating. Together with the increased amplification of the snare sound, the drum is more sensitive when played in the snare condition. In other words, the drum can be played more softly and yet a relatively greater, louder and more significant snare sound will result.

Although the port in the tubular tone ring is shown as continuous, extending as an unbroken gap completely around the periphery of the drum, it is contemplated that the edge 66 of the tone ring could be secured to the batter head assembly at several points around its circumference and thus provide a slightly or somewhat discontinuous port. Further, the port could be provided as a gap having an effective length greater than a major portion of the circumference of the snare head by employing a number of circumferentially spaced slots. Nevertheless, the completely continuous port illustrated is preferred since improved tone and amplification are achieved by the greater length of the resonating chamber port.

The foregoing detailed description is to be clearly understood as given by way of illustration and example only, the spirit and scope of this invention being limited solely by the appended claims.

What is claimed is:

1. A snare drum comprising mutually spaced and interconnected batter and snare head assemblies, a tone ring fixed to said snare head assemby and extending toward said batter head assembly, said tone ring defining a resonating chamber contiguous with said snare head assembly, said chamber having a port extending circumferentially about said drum in relatively close adjacency to said batter assembly and relatively remote from said snare head assembly.

2. A snare drum comprising a batter head assembly, a snare head assembly, a tone ring fixed to at least one of said assemblies and extending between said assemblies, said tone ring having a free end adjacent to but spaced from said batter head assembly to form a substantially continuous circumferential gap between said batter head assembly and said tone ring, said gap being located much closer to said batter head assembly than to said snare head assembly, and means for fixedly connecting said assemblies to each other.

3. The snare drum of claim 2 wherein said snare head assembly comprises a snare hoop, a snare head fixed to said snare hoop, a snare ring fixed to said snare hoop, and means for securing said tone ring to one of said snare hoop and snare ring.

4. The snare drum of claim 3 wherein said snare ring includes a circumferential shoulder, an axially extending circumferential flange circumscribing said shoulder, said tone ring having an axially facing bearing edge positioned within said flange and in close contiguity with said shoulder.

5. The snare drum of claim 4 wherein said snare hoop includes a plurality of circumferentially spaced radially outwardly projecting hoop flanges, said snare ring including a plurality of circumferentially spaced radially outwardly projecting ring flanges individually in registry with respective ones of said hoop flanges, fastening means extending between respective pairs of ring and hoop flanges for fixedly securing said snare ring and snare hoop to each other, a snare throw off assembly movably mounted to at least one of said snare ring and snare hoop, said snare head assembly including a plurality of wires movable into and out of contact with said snare head, and operating means connected between said wires and said throw off assembly.

6. The snare drum of claim 4 wherein said snare assembly includes a throw off support plate fixed to and upstanding from said snare ring and a throw off mechanism secured to said throw off support plate.

7. The snare drum of claim 6 including common fastening means for securing all of said tone ring, said throw off support plate, and said throw off mechanism to each other.

8. The snare drum of claim 7 wherein said tone ring is positioned between said support plate and said snare ring and between said support plate and said throw off mechanism.

9. The snare drum of claim 2 wherein said means for fixedly connecting said batter and snare head assemblies to each other comprises a plurality of circumferentially spaced radially inwardly extending bosses on each of said batter and snare assemblies and a plurality of support rods respectively extending between and connected to corresponding ones of said bosses on said snare and batter head assemblies.

10. A snare drum comprising a batter head assembly, a snare head assembly, means for holding said assemblies in fixed mutually spaced relation with respect to one another, and a tone ring fixed to said snare head assembly and extending toward said batter head assembly, said tone ring comprising a cylindrical element having a first edge in close contiguity with said snare head assembly and having a second edge adjacent to but spaced from said batter head assembly, said second edge and batter head assembly forming a gap located much closer to said batter head assembly than to said snare head assembly.

11. The snare drum of claim 10 wherein said second edge is free of contact with said batter head assembly to thereby define an open-ended resonating chamber contiguous to said snare head assembly.

12. A snare drum comprising a batter head assembly, a snare head assembly, means for fixedly connecting said assemblies to each other in mutually spaced relation, and a cylindrical tone ring fixed to at least said snare head assembly and extending between said snare and batter head assemblies, said tone ring defining a port closer to said batter head assembly than to said snare head assembly and connecting the interior of said tone ring with the exterior of said drum, said port extending circumferentially around said tone ring and having an effective length greater than a major portion of the circumference of said tone ring.

13. The snare drum of claim 12 wherein said port comprises a substantially continuous gap between said batter head assembly and an adjacent edge of said tone ring.

14. The snare drum of claim 12 wherein said snare head assembly includes a snare ring, a snare hoop fixed to said snare ring, a snare head fixed to said snare hoop, a snare assembly including snare wires movably mounted to one of said snare ring and snare hoop, said snare hoop having an axially facing circumferential shoulder, said tone ring having an axially facing edge seated upon said shoulder, and means for securing said tone ring to said snare ring.

15. The snare drum of claim 14 wherein said batter head assembly includes a batter ring, a batter hoop fixed to said batter ring and a batter head fixed to said batter hoop, and further including a plurality of circumferentially spaced support rods extending between and fixedly connected to said batter and snare rings respectively, said rods being positioned inwardly of said tone ring, said tone ring having a second axially facing edge adjacent to but spaced from said batter ring to provide a port extending circumferentially about said drum adjacent said batter head.

* * * * *